US012653327B2

(12) United States Patent
Oh et al.

(10) Patent No.: US 12,653,327 B2
(45) Date of Patent: Jun. 16, 2026

(54) MATTRESS ASSEMBLY AND FURNITURE INCLUDING SAME

(71) Applicant: COWAY CO., LTD., Gongju-si (KR)

(72) Inventors: Dong Min Oh, Seoul (KR); Jong Min Kim, Seoul (KR); Byung Il Kang, Seoul (KR)

(73) Assignee: COWAY CO., LTD., Gongju-si (KR)

( * ) Notice: Subject to any disclaimer, the term of this patent is extended or adjusted under 35 U.S.C. 154(b) by 0 days.

(21) Appl. No.: 18/727,357

(22) PCT Filed: Dec. 29, 2022

(86) PCT No.: PCT/KR2022/021565
§ 371 (c)(1),
(2) Date: Jul. 9, 2024

(87) PCT Pub. No.: WO2023/136513
PCT Pub. Date: Jul. 20, 2023

(65) Prior Publication Data

US 2025/0082112 A1 Mar. 13, 2025

(30) Foreign Application Priority Data

Jan. 13, 2022 (KR) ..... 10-2022-0004954

(51) Int. Cl.
*A47C 27/08* (2006.01)
*A47C 27/10* (2006.01)
*F04B 49/22* (2006.01)

(52) U.S. Cl.
CPC ..... *A47C 27/082* (2013.01); *A47C 27/083* (2013.01); *A47C 27/10* (2013.01); *F04B 49/22* (2013.01)

(58) Field of Classification Search
CPC ..... A47C 27/083; A47C 27/10; A47C 27/082; A47C 31/123; A47C 27/081
See application file for complete search history.

(56) References Cited

U.S. PATENT DOCUMENTS

2010/0064443 A1* 3/2010 Lee ..... A61G 7/05776 5/713
2014/0047645 A1* 2/2014 Choi ..... A47C 27/083 5/713

(Continued)

FOREIGN PATENT DOCUMENTS

JP 2004-344333 A 12/2004
KR 10-2080922 B1 2/2020

(Continued)

OTHER PUBLICATIONS

International Search Report issued Mar. 24, 2023 in PCT/KR2022/021565 filed on Dec. 29, 2022, 7 pages (with English Translation).

(Continued)

*Primary Examiner* — J. T. Newton
(74) *Attorney, Agent, or Firm* — Oblon, McClelland, Maier & Neustadt, L.L.P.

(57) ABSTRACT

A mattress assembly includes an air pocket, a flow channel, pumps for making air flow into the air pocket, a valve that regulates the air flow in the flow channel and air pocket, and a controller for controlling the pump and the valve so that the hardness of the air pocket changes. The flow channel includes first and second injection flow path members that provide passages for making the air flow from first and second pumps to a first and second air pockets, respectively, and an air flow path which communicates with the first and second injection flow path members. The valve includes a flow path valve for opening and closing the air flow path, and the controller controls the pump and the flow path valve so that the hardness of at least one of the first air pocket or the second air pocket changes.

9 Claims, 9 Drawing Sheets

(56) References Cited

U.S. PATENT DOCUMENTS

| | | | | |
|---|---|---|---|---|
| 2019/0174930 | A1* | 6/2019 | DeFranks | A47C 21/044 |
| 2025/0082112 | A1* | 3/2025 | Kim | A47C 27/08 |
| 2025/0134272 | A1* | 5/2025 | Park | A47C 27/15 |
| 2025/0194820 | A1* | 6/2025 | Kang | A47C 27/083 |

FOREIGN PATENT DOCUMENTS

| | | | |
|---|---|---|---|
| KR | 10-2020-0036469 | A | 4/2020 |
| KR | 10-2020-0055515 | A | 5/2020 |
| KR | 10-2020-0098617 | A | 8/2020 |
| KR | 10-2021-0059848 | A | 5/2021 |

OTHER PUBLICATIONS

Japanese Office Action issued Jun. 10, 2025 in Japanese Patent Application No. 2024-541282 (with English translation), 6 pages.

* cited by examiner

MATTRESS ASSEMBLY AND FURNITURE INCLUDING SAME

TECHNICAL FIELD

The present disclosure relates to a mattress assembly and furniture including the same.

BACKGROUND ART

Furniture may include chairs, beds, sofas, recliners, etc., on which a user may sit or lie. Such furniture may include a mattress to support a body weight of a user lying or sitting and a backrest to support the back or lower back of a user sitting on the mattress. In addition, the mattress may include a plurality of air cell units to provide cushions to multiple users, a plurality of pumps for making air flow into each air cell unit, and a controller for controlling the plurality of pumps.

However, when hardness of one of a plurality of air cell units of the conventional furniture changes, there is a problem that the hardness changes slowly since only air pressurized by one of the plurality of pumps is introduced.

In this regard, the present applicant's Korean Patent Application Publication No. 10-2020-005515 "Mattress including air cell assembly, and manufacturing and control method thereof" (Patent Document 1) discloses a mattress that includes a plurality of air cell units and a plurality of pumps for making air flow into each air cell unit.

However, when the hardness of the plurality of air cell units of the mattress of Patent Document 1 changes, only the pressurized air is introduced from one of the plurality of pumps, so there is a problem in that the hardness changes slowly. In other words, there is a problem in that the hardness of one of the plurality of air cell units of the mattress of Patent Document 1 does not quickly change by the air introduced from the plurality of pumps.

In addition, since the mattress of Patent Document 1 adjusts the hardness of one air cell unit with one pump, there is a problem that it is difficult for a user lying on the mattress to feel the change in hardness.

Related Art Document (Patent Document) Korean Patent Application Publication 10-2020-0055515 (published on May 21, 2020)

DETAILED DESCRIPTION OF INVENTION

Technical Problems

According to one embodiment of the present disclosure, the present disclosure provides a mattress assembly and furniture in which hardness of one or more of a plurality of air pocket units can quickly change.

According to another embodiment of the present disclosure, the present disclosure provides a mattress assembly and furniture that allows a user to easily feel changes in hardness of a plurality of air pocket units.

Technical Solution

In accordance with one embodiment of the present disclosure, a mattress assembly, comprising: a plurality of air pocket units that include a first air pocket unit and a second air pocket unit for receiving air to support a user: a flow channel that provides a flow path through which the air flows: a plurality of pumps that include a first pump and a second pump for making the air flow into one or more of the plurality of air pocket units: a valve unit that includes a plurality of valves selectively opened and closed to control the flow of air in the flow channel and the plurality of air pocket units; and a controller that controls the plurality of pumps and the valve unit to change hardness of one or more of the plurality of air pocket units, wherein the flow channel includes a first injection flow path member that provides a passage for the air to flow from the first pump to the first air pocket unit: a second injection flow path member providing a passage through which the air flows from the second pump to the second air pocket unit; and an air flow path communicating with the first injection flow path member and the second injection flow path member, and the plurality of valves include a flow path valve that selectively open and close the air flow path, and the controller controls the plurality of pumps and the flow path valve so that the hardness of one or more of the first air pocket unit and the second air pocket unit changes by the air introduced by the plurality of pumps.

Further, the one or more valves may further include: a first injection valve that opens and closes the first injection flow path member to make the air flow into the first air pocket unit; and a second injection valve that opens and closes the second injection flow path member to make the air flow into the second air pocket unit, and the controller may close either of the first injection valve or the second injection valve and opens the flow path valve so that the hardness of only one of the first air pocket unit and the second air pocket unit changes by the air introduced by the first pump and the second pump.

Further, each of the plurality of air pocket units may be divided into a plurality of pocket areas, the controller may control the plurality of pumps and the valve unit based on one or more control modes so that the hardness of one or more of the plurality of air pocket units changes, the one or more control modes may include a relaxation mode in which a relaxation drive is performed one or more times to change the hardness of one or more of the plurality of air pocket units, and in the relaxation drive, one or more of the plurality of air pocket units may be selected by a signal from an outside, and the valve unit and the pump are controlled so that, when the relaxation mode is selected, the hardness of some of the plurality of pocket areas of the selected air pocket unit changes for a predetermined first opening time, and the hardness of the other some of the plurality of pocket areas of the selected air pocket unit changes for a predetermined second opening time.

Further, in the relaxation drive, before the pump operates, at least some of the plurality of valves may be opened so that the plurality of pocket areas of the selected air pocket unit communicate with each other for a predetermined relaxation waiting time, and after the relaxation waiting time, at least some of the plurality of valves may be opened so that the air is discharged from the selected air pocket unit for a predetermined relaxation discharge time.

Further, the mattress assembly may further comprise: a sensor unit that detects the pressure of the plurality of air pocket units, wherein, after the second opening time, when the pressure of the selected air pocket unit measured through the sensor unit is lower than a preset reference pressure, the pump is re-driven to reach the reference pressure, and if the pressure of the selected air pocket unit is higher than the preset reference pressure, the relaxation drive ends, when the pressure of the selected air pocket unit measured through the sensor unit is greater than or equal to the preset reference pressure, the pump ends without being driven, and the controller controls the valve unit and the pump so that the relaxation drive is repeatedly performed for multiple times.

Further, the mattress assembly may further comprise: a sensor unit that detects the pressure of the plurality of air pocket units, when the relaxation mode ends, the controller controls to make a plurality of pocket areas of the selected air pocket unit communicate with each other for a predetermined grace time, and discharge the valve unit to discharge the air from the selected air pocket unit for a predetermined exhaust time after the grace time, and after the exhaust time, controls to re-drive the pump to reach the reference pressure when the pressure of the selected air pocket unit measured through the sensor unit is lower than the preset reference pressure, and controls the pump and the valve unit to prevent the air from flowing into the pocket area of the selected air pocket unit when pressure of the selected air pocket unit measured through the sensor unit is greater than or equal to the preset reference pressure.

Further, the controller may be preset to a hardness level of 3 or more for the hardness of the air pocket unit, the one or more control modes further include a scan mode that increases or decreases the hardness level of one or more of the plurality of air pocket units to 3 or more, and the controller controls the pump and the valve unit so that the scan mode is performed for the selected air pocket unit when one or more of the plurality of air pocket units is selected by a signal from the outside.

Further, the controller may control the pump and the valve unit to maintain the hardness level of the selected air pocket unit when the signal from the outside occurs if the scan mode ends by the signal from the outside.

Further, a furniture, may comprise: the mattress assembly; and a backrest disposed on one side of the mattress assembly.

Effect of Invention

According to one embodiment of the present disclosure, it is possible to allow hardness of one or more of a plurality of air pocket units to quickly change by air introduced by a plurality of pumps.

In addition, since hardness of a plurality of air pocket units may be adjusted by a plurality of pumps, it is possible for a user to easily feel the change in the hardness of the plurality of air pocket units.

BEST MODE FOR CARRYING OUT THE INVENTION

Figure 1:
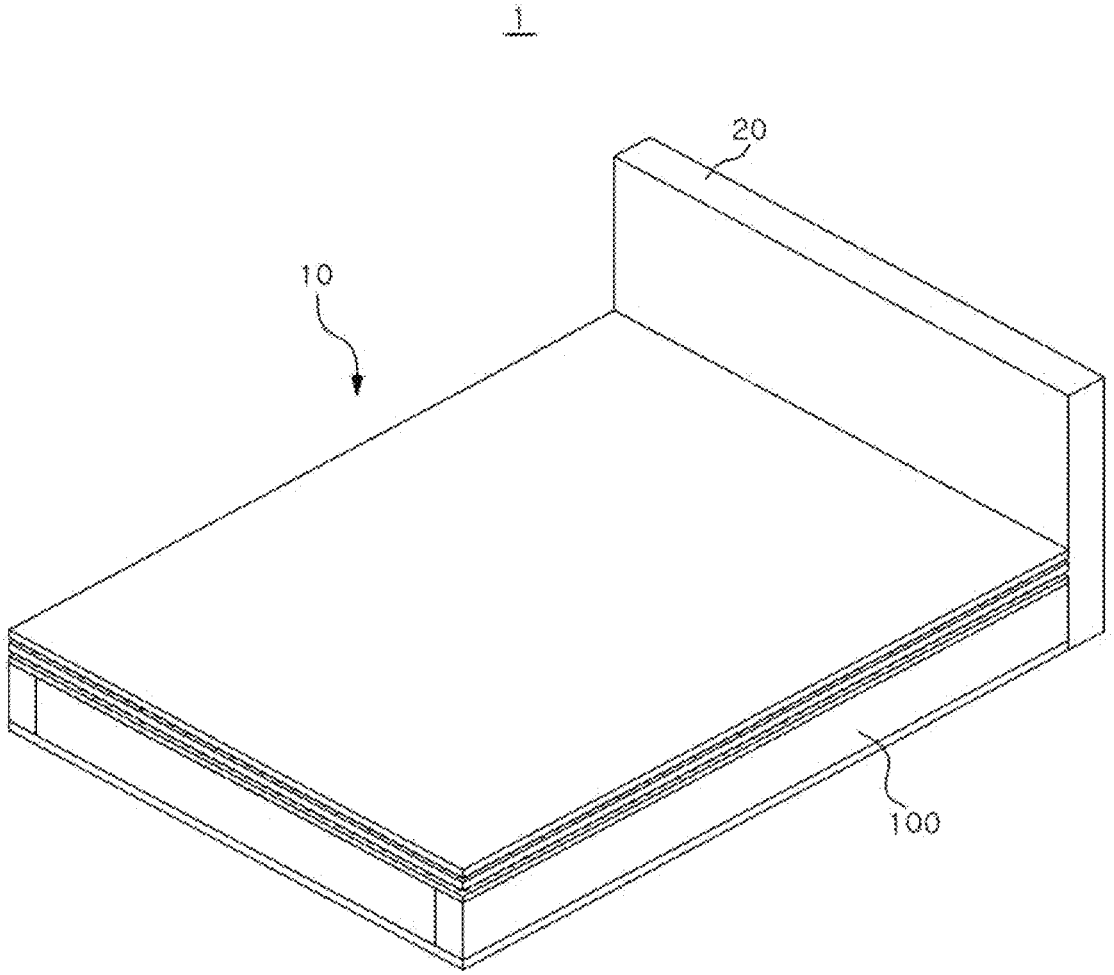
FIG. 1 is a perspective view of a mattress assembly and furniture including the same according to an embodiment of the present disclosure.

Hereinafter, specific embodiments for implementing the technical idea of the present disclosure will be described in detail with reference to the accompanying drawings.

In describing embodiments of the present disclosure, well-known functions or constructions will not be described in detail since they may unnecessarily obscure the understanding of the present disclosure.

It is to be understood that when one element is referred to as being "connected to" and "communicating with" another element, it may be directly connected to, communicate with another element, having the other element intervening therebetween.

Terms used in the present specification are used only in order to describe specific exemplary embodiments rather than limiting the present disclosure. Singular forms are intended to include plural forms unless the context clearly indicates otherwise.

In addition, in the present specification, terms "upper side", "lower side", "side surface", and the like, are represented based on the drawings and may be differently represented when directions of corresponding targets are changed. For the same reason, it is to be noted that some components shown in the drawings are exaggerated, omitted or schematically illustrated, and the size of each component does not exactly reflect its real size.

In addition, terms including ordinal numbers such as "first," "second," and the like, may be used to describe various components. However, these components are not limited by these terms. The terms are used only to distinguish one component from another component.

A term "including" used in the present specification concretely indicates specific properties, regions, integer numbers, steps, operations, elements, and/or components, and is not to exclude presence or addition of other specific properties, regions, integer numbers, steps, operations, elements, components, and/or a group thereof.

Hereinafter, furniture 1 according to an embodiment of the present disclosure will be described with reference to the drawings.

Referring to FIG. 1, the furniture 1 is a device or appliance that may support a user and may be a bed, a chair, a sofa, a recliner, etc. The furniture 1 may include a mattress assembly 10 and a backrest 20.

Figure 2:
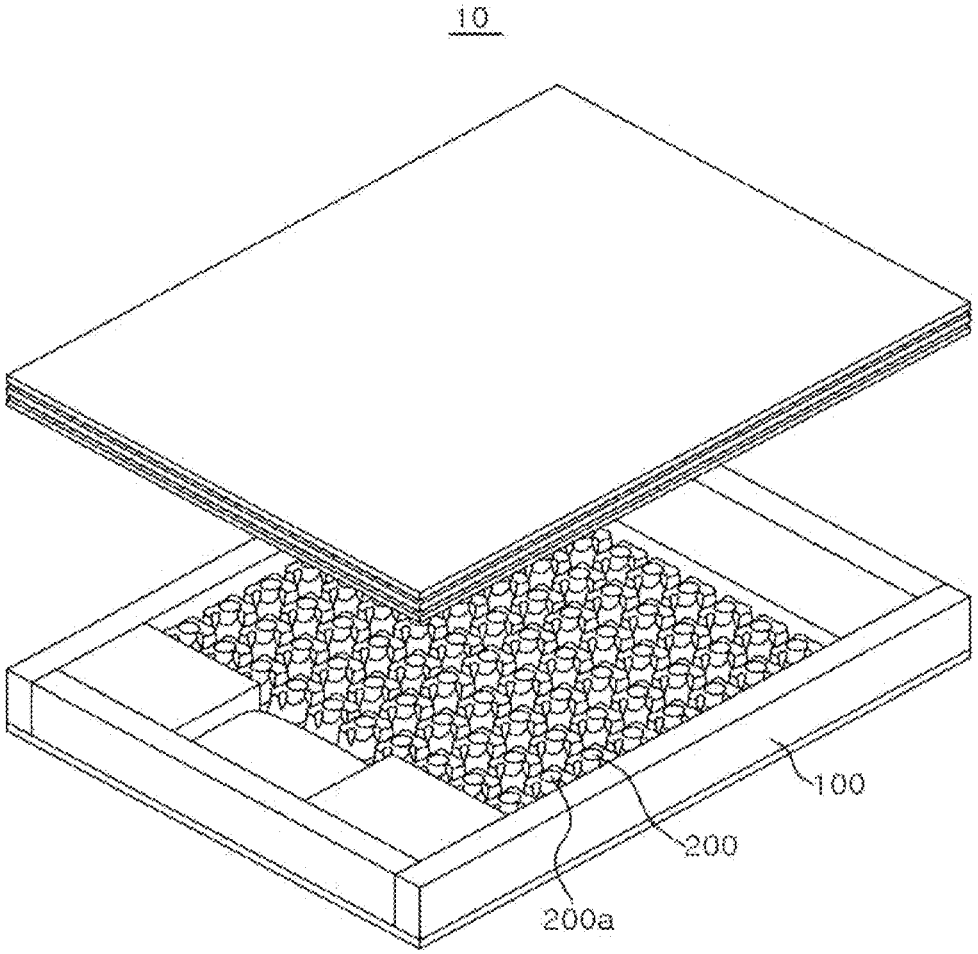
FIG. 2 is an exploded perspective view of the mattress assembly according to the embodiment of the present disclosure.
Figure 3:
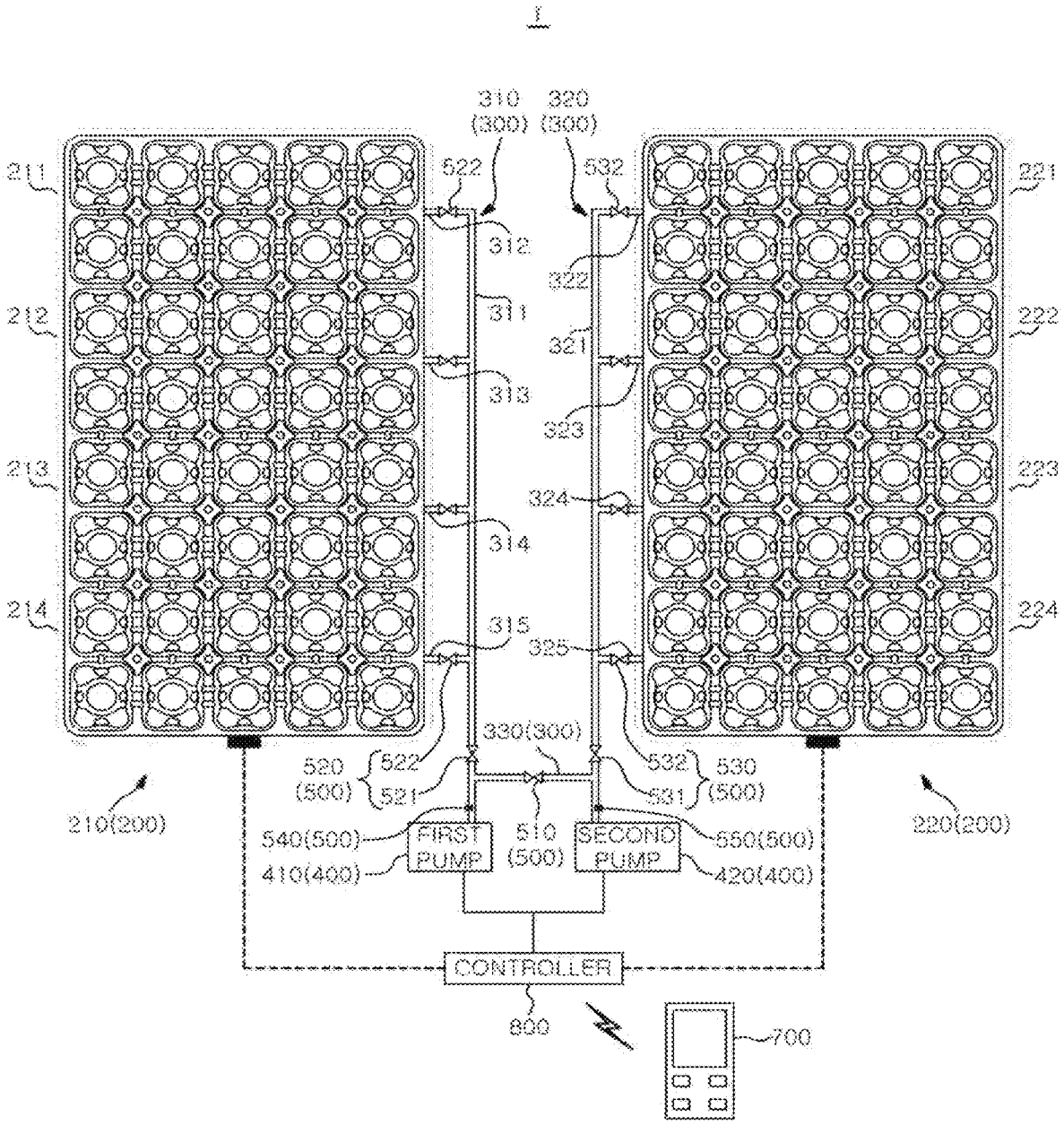
FIG. 3 is a block diagram of the mattress assembly according to the embodiment of the present disclosure.

Referring further to FIGS. 2 and 3, the mattress assembly 10 may be formed to be extended in a horizontal direction to support a user's body weight. In other words, the mattress assembly 10 may support a user who is lying or sitting. The mattress assembly 10 includes a main body unit 100, a plurality of air pocket units 200, a flow channel 300, a plurality of pumps 400, a valve unit 500, a sensor unit 600, an operating unit 700, and a controller 800.

The main body unit 100 may accommodate an air pocket unit 200, a flow channel 300, a pump 400, a valve unit 500, a sensor unit 600, and a controller 800. The main unit 100 may include a housing that forms an exterior of the mattress assembly 10.

The plurality of air pocket units 200 are accommodated in the main body unit 100, and air may be accommodated to change hardness. In other words, the hardness of the plurality of air pocket units 200 may change to suit the user's body supported on the mattress assembly 10, and may change to massage the plurality of users when they lie down on the mattress assembly 10. The hardness of each of the plurality of air pocket units 200 may be formed differently. In addition, the plurality of air pocket units 200 may include a first air pocket unit 210 and a second air pocket unit 220.

The hardness of the first air pocket unit 210 may change by air introduced by one or more of the plurality of pumps 400. The first air pocket unit 210 may be disposed on one side of the second air pocket unit 220. The first air pocket unit 210 may provide hardness suited to one (hereinafter, a first user) of a plurality of users. In addition, the first air pocket unit 210 may include a plurality of pocket areas 211, 212, 213, and 214. The plurality of pocket areas 211, 212, 213, and 214 of the first air pocket unit 210 are arranged in the horizontal direction and may have different hardness due to the introduction of air. The plurality of pocket areas 211, 212, 213, and 214 of the first air pocket unit 210 may include a first pocket area 211, a second pocket area 212, a third pocket area 213, and a fourth pocket area 214. For example, when the first user is lying down on the mattress assembly 10, the first pocket area 211 may support a shoulder area of the first user, the second pocket area 212 may support a waist of the first user, the third pocket area 213 may support a hip area of the first user, and the fourth pocket area 214 may support a thigh area of the first user.

The hardness of the second air pocket unit 220 may change by air introduced by one or more of the plurality of pumps 400. The second air pocket unit 220 may provide hardness suited to the other (hereinafter, a second user) of a plurality of users. In addition, the second air pocket unit 220 may include a plurality of pocket areas 221, 222, 223, and 224. The plurality of pocket areas 221, 222, 223, and 224 are arranged in a horizontal direction and may have different hardness due to the introduction of air. The plurality of pocket areas 221, 222, 223, and 224 of the second air pocket unit 220 may include a fifth pocket area 221, a sixth pocket area 222, a seventh pocket area 223, and an eighth pocket area 224. For example, when the second user is lying down on the mattress assembly 10, the fifth pocket area 221 may support a shoulder area of the second user, the sixth pocket area 222 may support the waist area of the second user, the seventh pocket area 223 may support a hip area of the second user, and the eighth pocket area 224 may support a thigh area of the second user.

Each of the plurality of air pocket units 200 may include a plurality of air pockets 220*a*. In other words, the plurality of air pockets 220*a* may be included in each of the plurality of pocket areas 211, 212, 213, 214, 221, 222, 223, and 224. The plurality of air pockets 220*a* may accommodate or discharge air pressurized by the plurality of pumps 400. The plurality of air pockets 220*a* may be arranged in a horizontal direction. The plurality of air pockets 220*a* may have different hardness by accommodating and discharging air. In other words, the plurality of air pockets 220*a* may provide different hardness for each part of the user's body.

The flow channel 300 may provide a passage that communicates with the plurality of air pocket units 200 to guide air to the air pocket unit 200 or discharge air from the air pocket unit 200. The flow channel 300 may include a first injection flow path member 310, a second injection flow path member 320, and an air flow path 330.

The first injection flow path member 310 may provide a passage through which the air pressurized by one or more of the plurality of pumps 400 flows into the first air pocket unit 210 or the air discharged from the first air pocket unit 210 is discharged to the outside. The first injection flow path member 310 may include a first injection flow path 311, a second injection flow path 312, a third injection flow path 313, a fourth injection flow path 314, and a fifth injection flow path 315.

The first injection flow path 311 may provide a passage through which air flows into the second injection flow path 312, the third injection flow path 313, the fourth injection flow path 314, and the fifth injection flow path 315, respectively, or the air discharged from the first air pocket unit 210 is discharged to the outside. The first injection flow path 311 may communicate with a second injection flow path 312, a third injection flow path 313, a fourth injection flow path 314, and a fifth injection flow path 315. In addition, the first injection flow path 311 may be connected to a first pump 410, which will be described later, among the plurality of pumps 400.

The second injection flow path 312 may provide a passage through which air flows into the first pocket area 211 via the first injection flow path 311 or the air discharged from the first pocket area 211 flows into the first injection flow path 311. The second injection flow path 312 may communicate with the first pocket area 211.

The third injection flow path 313 may provide a passage through which air flows into the second pocket area 212 via the first injection flow path 311 or the air discharged from the second pocket area 212 flows into the first injection flow path 311. The third injection flow path 313 may communicate with the second pocket area 212.

The fourth injection flow path 314 may provide a passage through which air flows into the third pocket area 213 via the first injection flow path 311 or the air discharged from the second pocket area 212 flows into the first injection flow path 311. The fourth injection flow path 314 may communicate with the third pocket area 213.

The fifth injection flow path 315 may provide a passage through which air flows into the fourth pocket area 214 via the first injection flow path 311 or the air discharged from the fourth pocket area 214 flows into the first injection flow path 311. The fifth injection flow path 315 may communicate with the fourth pocket area 214.

The second injection flow path member 320 may provide a passage through which the air pressurized by one or more of the plurality of pumps 400 flows into the second air pocket unit 220 or the air discharged from the second air pocket unit 220 is discharged to the outside. This second injection flow path member 320 may include a first injection connection flow path 321, a second injection connection flow path 322, a third injection connection flow path 323, a fourth injection connection flow path 324, and a fifth injection connection flow path 325.

The first injection connection flow path 321 may provide a passage through which air flows into the second injection connection flow path 322, the third injection connection flow path 323, the fourth injection flow connection path 324, and the fifth injection connection flow path 325, respectively, or the air discharged from the second air pocket unit 220 is discharged to the outside. The first injection connection flow path 321 may communicate with the second injection connection flow path 322, the third injection connection flow path 323, the fourth injection connection flow path 324, and the fifth injection connection flow path 325. In addition, the first injection connection flow path 321 may be connected to a second pump 420, which will be described later, among the plurality of pumps 400.

The second injection connection flow path 322 may provide a passage through which air flows into the fifth pocket area 221 via the first injection connection flow path 321 or the air discharged from the fifth pocket area 221 flows into the first injection connection flow path 321. The second injection connection flow path 322 may communicate with the fifth pocket area 221.

The third injection connection flow path 323 may provide a passage through which air flows into the sixth pocket area 222 via the first injection connection flow path 321 or the air discharged from the sixth pocket area 221 flows into the first injection connection flow path 321. The third injection connection flow path 323 may communicate with the sixth pocket area 222.

The fourth injection connection flow path 324 may provide a passage through which air flows into the seventh pocket area 223 via the first injection connection flow path 321 or the air discharged from the seventh pocket area 223 flows into the first injection connection flow path 321. The fourth injection connection flow path 324 may communicate with the seventh pocket area 223.

The fifth injection connection flow path 325 may provide a passage through which air flows into the eighth pocket area 224 via the first injection connection flow path 321 or the air discharged from the eighth pocket area 224 flows into the first injection connection flow path 321. The fifth injection connection flow path 325 may communicate with the eighth pocket area 224.

The air flow path 330 may provide a passage through which the air from the plurality of pumps 400 flows into one of the first air pocket unit 210 or the second air pocket unit 220. The air flow path 330 may communicate with the first injection flow path member 310 and the second injection flow path member 320. For example, the air flow path 330 may be disposed between the first injection flow path member 311 and the second injection flow path member 321.

The plurality of pumps 400 may be driven to make air flow into one or more of the plurality of air pocket units 200. The plurality of pumps 400 may include a first pump 410 and a second pump 420.

The first pump 410 may be driven to make air flow into one or more of the first injection flow path member 310 and the second injection flow path member 320. The first pump 410 may be connected to the first injection flow path member 310 and pressurize the air flowing from the first injection flow path member 310. For example, the first pump 410 may be provided on the first injection flow path 311.

The second pump 420 may be driven to make air flow into one or more of the first injection flow path member 310 and the second injection flow path member 320. The second pump 420 may be connected to the second injection flow path member 320 and pressurize the air flowing from the first injection flow path member 310. For example, the second pump 420 may be provided on the first injection flow path 321.

The valve unit 500 may include one or more valves that are selectively opened and closed to control the flow of air in the flow channel 300 and the plurality of air pocket units 200. One or more valves may include a flow path valve 510, a first injection valve 520, a second injection valve 530, a first exhaust valve 540, and a second exhaust valve 550.

The flow path valve 510 may selectively open and close the air flow path 330. When the air flow path 330 is opened by the flow path valve 510, the air pressurized by the plurality of pumps 400 may flow into the first air pocket unit 210 through the first injection flow path member 310 or flow into the second air pocket unit 220 through the second injection flow path member 320. In addition, when the air flow path 330 is opened by the flow path valve 510, the air pressurized by the first pumps 410 may flow into the first air pocket unit 210 through the first injection flow path member 310 or the air pressurized by the second pump 420 may flow into the second air pocket unit 220 through the second injection flow path member 320.

One or more first injection valves 520 may be provided to selectively open and close the first injection flow path member 310 to block air flowing into the first air pocket unit 210. The first injection valve 520 may include a first main injection valve 521 and a plurality of first auxiliary injection valves 522.

The first main injection valve 521 may selectively open and close the first injection flow path 311. When the first main injection valve 521 is opened, the air pressurized by the first pump 410 may flow toward one or more of the second injection flow path 312, the third injection flow path 313, and the fourth injection flow path 314, and the fifth injection flow path 315. In addition, when the first main injection valve 521 is opened, the air discharged from the first air pocket unit 210 may flow toward the first exhaust valve 540.

The plurality of first auxiliary injection valves 522 may be provided on the second injection flow path 312, the third injection flow path 313, the fourth injection flow path 314, and the fifth injection flow path 315, respectively, and open and close the second injection flow path 312, the third injection flow path 313, the fourth injection flow path 314, and the fifth injection flow path 315. When one or more of the plurality of first auxiliary injection valves 522 is opened, the air pressurized by the first pump 410 is supplied to one or more of the first pocket area 211, the second pocket area 212, the third pocket area 213, and the fourth pocket area 214. In addition, when one or more of the plurality of first auxiliary injection valves 522 is opened, the air discharged from one or more of the first pocket area 211, the second pocket area 212, the third pocket area 213, and the fourth pocket area 214 may flow into the first injection flow path 311.

The second injection valve 530 may selectively open and close the second injection flow path member 320 to block the flow into the second air pocket unit 220 or the second air pocket unit 220. In addition, the second injection valve 530 may include a first main injection valve 531 and a plurality of second auxiliary injection valves 532.

The second main injection valve 531 may selectively open and close the first injection connection flow path 321. When the second main injection valve 531 is opened, the air pressurized by the first pump 410 may flow toward one or more of the second injection connection flow path 322, the third injection connection flow path 323, the fourth injection connection flow path 324, and the fifth injection connection flow path 325. In addition, when the second main injection valve 531 is opened, the air discharged from the second air pocket unit 220 may flow toward the first exhaust valve 540.

The plurality of second auxiliary injection valves 532 may be provided on the second injection connection flow path 322, the third injection connection flow path 323, the fourth injection connection flow path 324, and the fifth injection connection flow path 325, respectively, and may open and close the second injection connection flow path 322, the third injection connection flow path 323, the fourth injection connection flow path 324, and the fifth injection connection flow path 325. When one or more of the plurality of second auxiliary injection valves 532 are opened, the air pressurized by the second pump 420 may be supplied to one or more of the fifth pocket area 221, the sixth pocket area 222, the seventh pocket area 223, and the eighth pocket area 224. In addition, when one or more of the plurality of second auxiliary injection valves 532 is opened, the air discharged from one or more of the sixth pocket area 222, the seventh pocket area 223, and the eighth pocket area 224 may flow into the first injection connection flow path 321.

The first exhaust valve 540 may be provided on the first injection flow path member 310 and open and close the first injection flow path member 310 to discharge air from the first injection flow path member 310 to the outside. For example, the first exhaust valve 540 may be provided on the first injection flow path 311. When the first exhaust valve 540 is opened, the hardness of the first air pocket unit 210 may be reduced. In addition, when the first exhaust valve 540 is opened, the first main injection valve 521 and the plurality of first auxiliary injection valves 522 may also be opened.

The second exhaust valve 550 may be provided on the second injection flow path member 320 to open and close the second injection flow path member 320 so that air is discharged from the second air pocket unit 220. For example, the second exhaust valve 550 may be provided on the first injection connection flow path 321. When the second exhaust valve 550 is opened, the hardness of the second air pocket unit 220 may be reduced.

The sensor unit 600 may detect the pressure of the plurality of air pocket units 200. The sensor unit 600 may include a first sensor unit 610 and a second sensor unit 620.

The first sensor unit 610 may detect the pressure of the first air pocket unit 210. The pressure detected by the first sensor unit 610 may be an average pressure of the plurality of pocket areas 211, 212, 213, and 214 of the first air pocket unit 210.

The second sensor unit 620 may detect the pressure of the second air pocket unit 220. The pressure detected by the second sensor unit 620 may be an average pressure of the plurality of pocket areas 221, 222, 223, and 224 of the second air pocket unit 210.

Through the operating unit 700, the user may adjust the hardness level of the air pocket unit 200, which will be described later. The operating unit 700 operates to change the hardness of one or more of the plurality of air pocket units 200 or to select one or more of the plurality of air pocket units 200 and transmits a signal to the controller 800 in a wirelessly or wired manner. The signal may include one or more of a signal for selecting one or more of the plurality of air pocket units 200, a signal for changing a current hardness level, which is the currently set hardness level to be described later, of the selected air pocket unit 200 to a change hardness level, which is another hardness level, a signal for selecting a control mode to be described later, a signal for ending the control mode, and a signal for selecting a time when the control mode operates. For example, the operating unit 700 may be a remote control, an operation panel including a plurality of buttons, etc. In addition, the operating unit 700 may be equipped with a display panel, and information on the mattress assembly 10 may be displayed on the display panel. For example, the information may include the pressure, the hardness level, the control mode, the control mode operation time, etc., of the plurality of air pocket units 200.

Meanwhile, the function of the operating unit 700 may be implemented by a portable terminal such as a smartphone. In other words, the controller 800 may be operated by an external signal input by an application etc., of a portable terminal such as a smartphone, so the operating unit 700 is not necessarily an essential component in the mattress assembly 10 and may be omitted.

The controller 800 controls the plurality of pumps 400 and the valve unit 500 so that the hardness of one or more of the plurality of air pocket units 200 is set to one of the plurality of preset hardness levels by the signal from the outside. The hardness level may be a pressure value pre-entered into the controller 800 to adjust the hardness of the air pocket unit 200. As the hardness level increases, the internal pressure and hardness of the air pocket unit 200 may increase. For example, the plurality of hardness levels may include a total of 9 hardness levels in which the hardness level increases as the internal pressure of the air pocket unit 200 increases. In addition, the preset pressures corresponding to a total of 9 hardness levels may be stage 1:0.14 psi, stage 2:0.28 psi, stage 3:0.42 psi, stage 4:0.56 psi, stage 5:0.70 psi, stage 6:0.84 psi, stage 7:0.98 psi, stage 8:1.12 psi, and stage 9:1.34 psi. In other words, 0.14 psi may be increased per stage. The signal from the outside may be a signal input from the operating unit 700 or a signal input through an application or the like of a mobile terminal. In addition, the plurality of hardness levels may include hardness levels of 3 or more.

Figure 4:
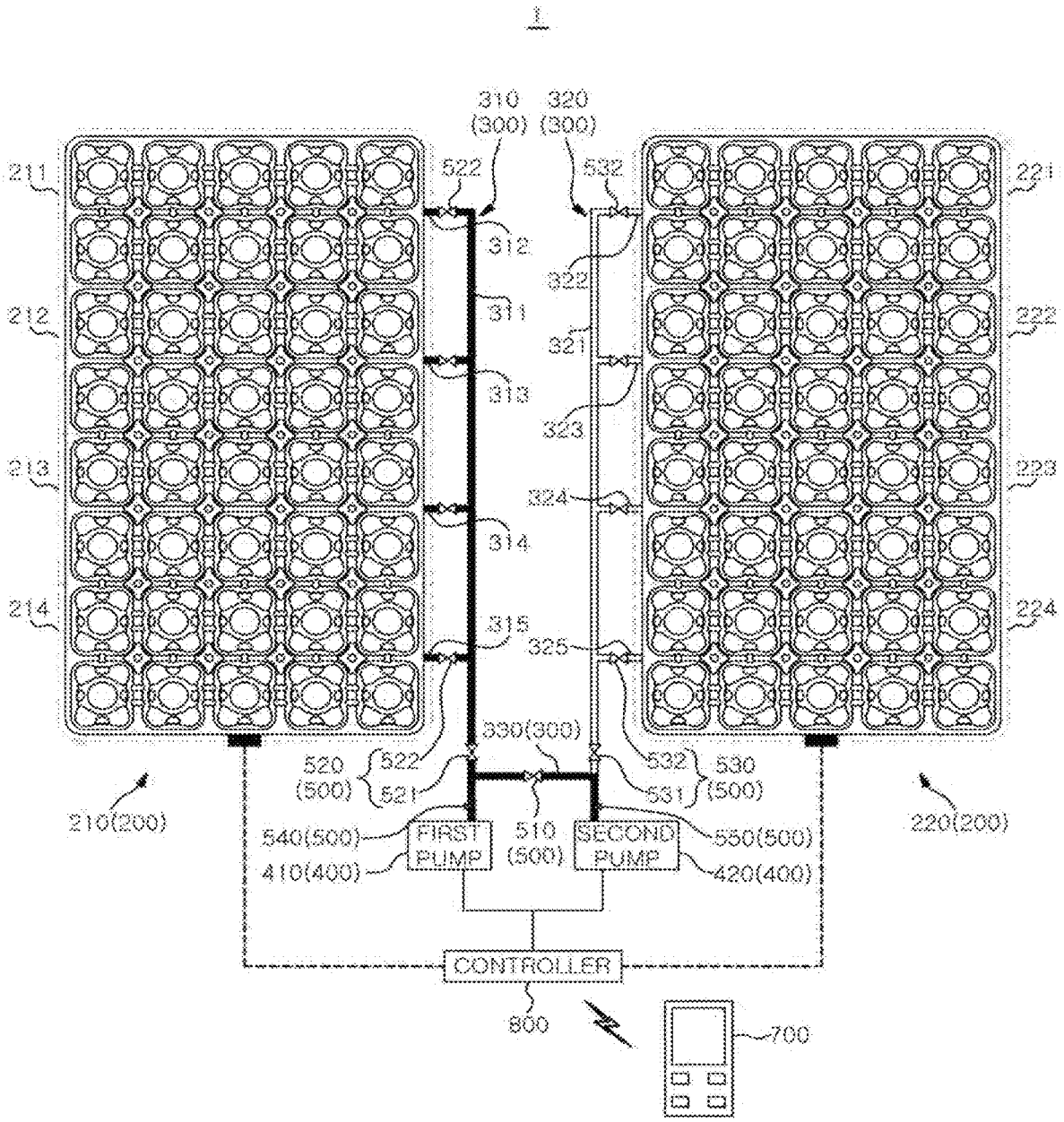
FIG. 4 is a block diagram illustrating an appearance in which a flow path valve of the mattress assembly of FIG. 3 is opened and air flows from a plurality of pumps to a first air pocket unit.
Figure 5:
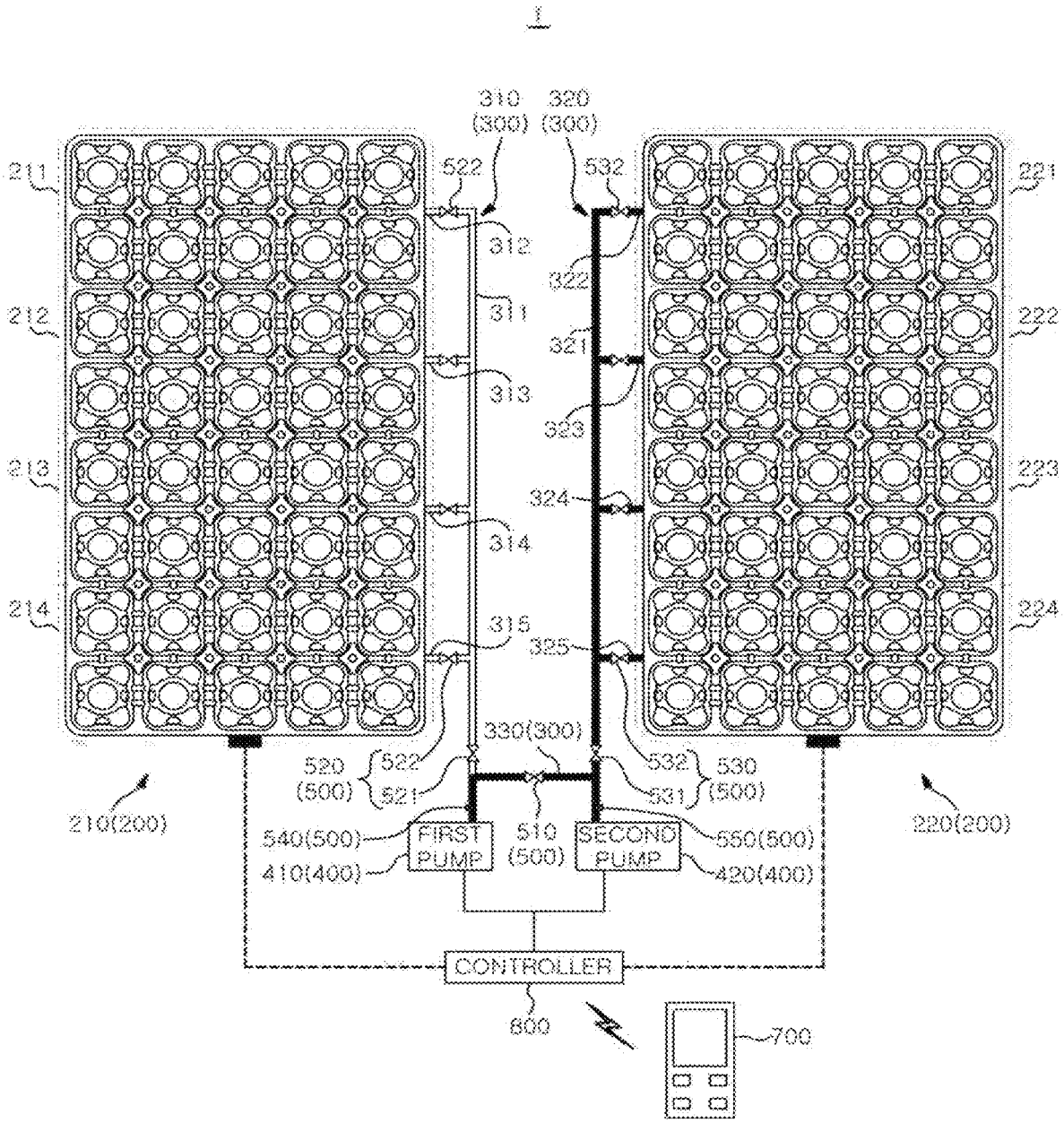
FIG. 5 is a block diagram illustrating an appearance in which the flow path valve of the mattress assembly of FIG. 3 is opened and air flows from the plurality of pumps to a second air pocket unit.

Referring to FIGS. 4 and 5, as an example, the controller 800 may selectively change the hardness of only one of the plurality of air pocket units 200 by the signal from the outside. In other words, the controller 800 may close one of the first injection valve 520 or the second injection valve 530 and open the flow path valve 510 so that the hardness of only one of the first air pocket unit 210 and the second air pocket unit 220 changes by the air introduced by the first pump 410 and the second pump 420.

Figure 6:
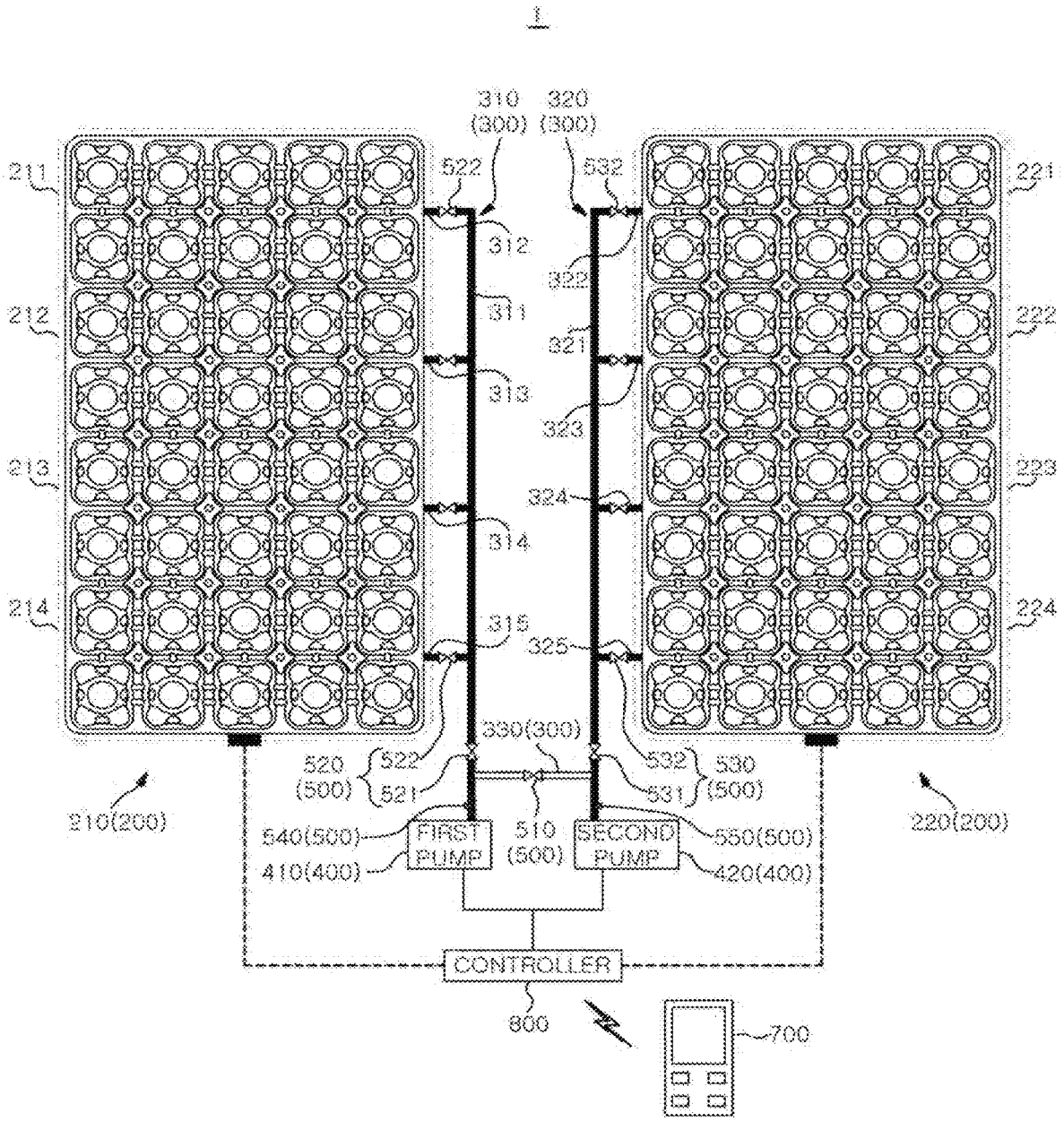
FIG. 6 is a block diagram illustrating an appearance in which the flow path valve of the mattress assembly of FIG. 3 is closed and air flows from the plurality of pumps to a plurality of air pocket units.

Referring to FIG. 6, as another example, the controller 800 may change the hardness of the plurality of air pocket units 200 by the signal from the outside. In other words, the controller 800 may open the first injection valve 520 or the second injection valve 530 and open the flow path valve 510 and close the flow path valve 510 so that the hardness of the first air pocket unit 210 changes by the air introduced by the first pump 410 and the hardness of the second air pocket unit 220 changes by the second pump 420.

Figure 7:
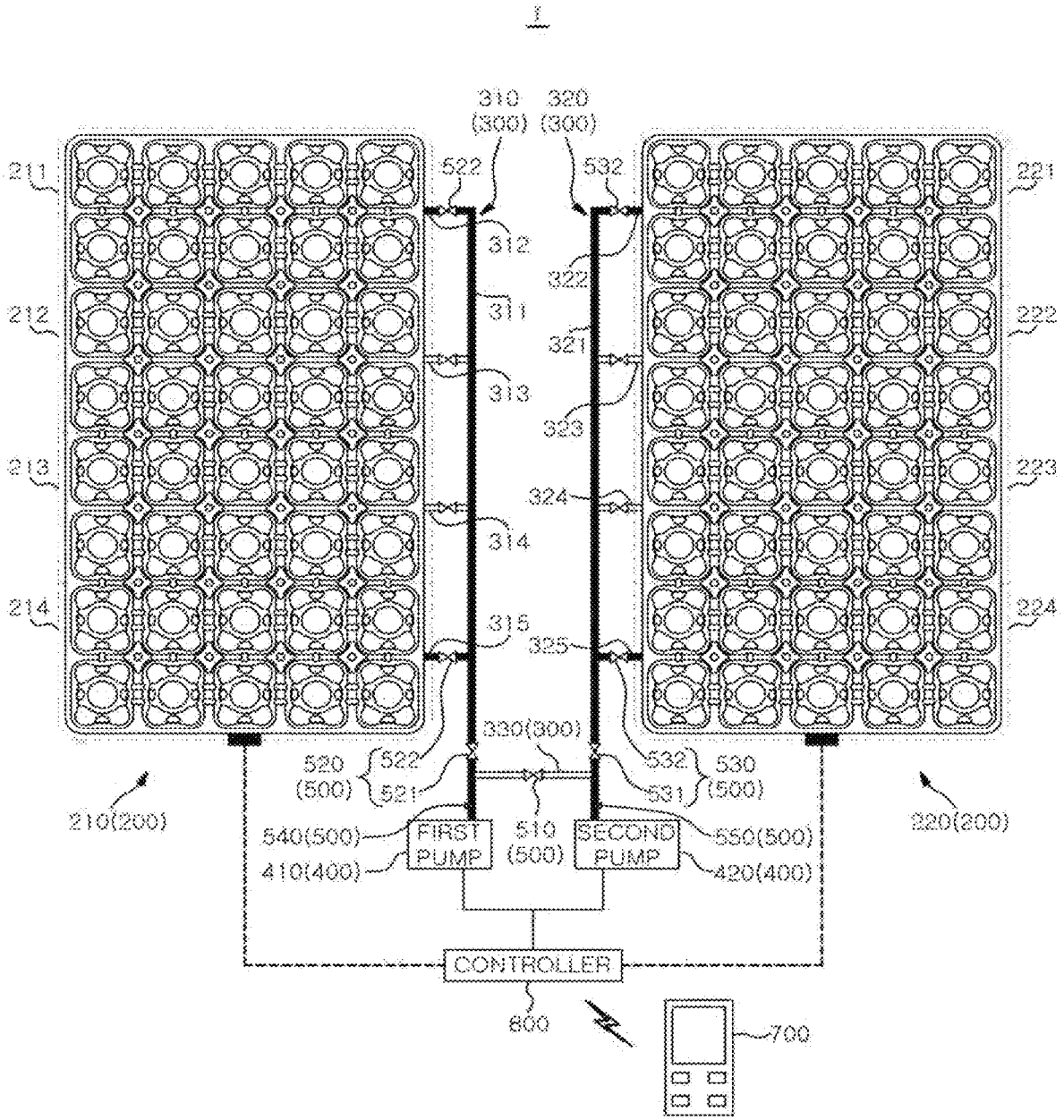
FIG. 7 is a block diagram illustrating an appearance in which air flows through some of a plurality of pocket areas of the plurality of air pocket units of FIG. 3.
Figure 8:
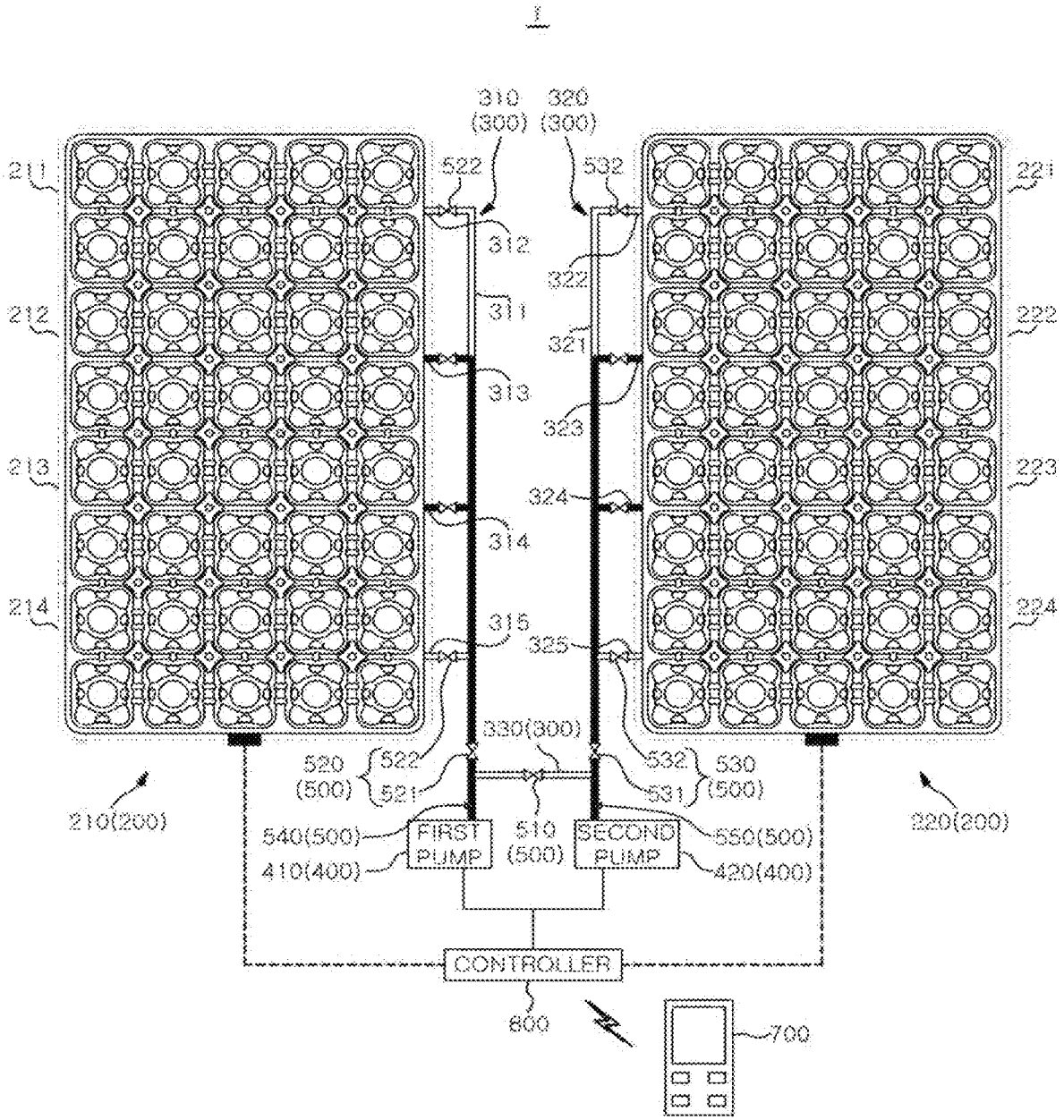
FIG. 8 is a block diagram illustrating an appearance in which air flows through the other some of the plurality of pocket areas of the plurality of air pocket units of FIG. 3.
Figure 9:
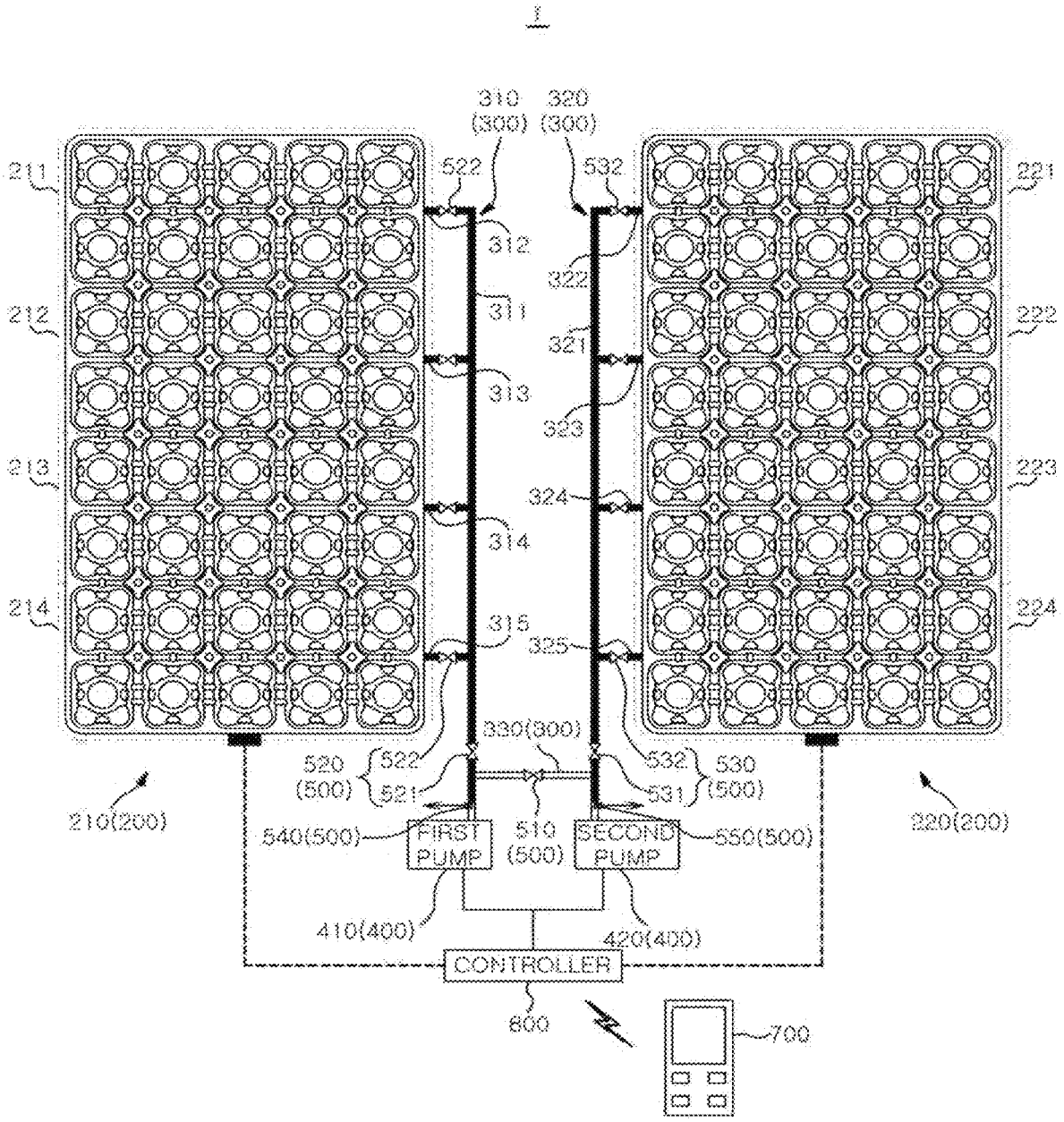
FIG. 9 is a block diagram illustrating an appearance in which air discharged from the plurality of air pocket units of the mattress assembly of FIG. 3 is discharged to the outside through an exhaust valve.

Referring further to FIGS. 7 to 9, the controller 800 may control the plurality of pumps 400 and the valve unit 500 based on one or more control modes so that the hardness of one or more of the plurality of air pocket units 200 changes. One or more control modes may include the relaxation mode and the scan mode.

The relaxation mode is a mode in which relaxation drive is performed one or more times to change the hardness of one or more of the plurality of air pocket units 200. This relaxation mode may repeatedly change the hardness of the air pocket unit 200 in a predetermined pattern to provide a massage feeling and comfort to the user lying on the mattress assembly 10. As a more specific example, the relaxation mode may repeatedly provide different hardness for each part of the user's body in the predetermined pattern to provide a different massage feeling for each part of the user's body. When in relaxation mode, the controller 800 may control the plurality of valves 510, 520, 530, 540, and 550 and the plurality of pumps 400 to repeat the relaxation drive. In other words, the relaxation drive may be repeated multiple times for a predetermined mode operation time set by a signal. For example, the mode operation time may be 5 to 20 minutes.

In this relaxation drive, the plurality of valves 510, 520, 530, 540, and 550 and the plurality of pumps 400 may be controlled so that the hardness of some of the plurality of pocket areas 211, 212, 213, 214, 221, 222, 223, and 224 of the air pocket unit 200 selected by the signal from the outside changes for a predetermined first opening time. Due to this relaxation drive, the air may flow into some of the plurality of pocket areas 211, 212, 213, 214, 221, 222, 223, and 224 of the selected air pocket unit 200, so the hardness may increase. For example, the first opening time may be 12 to 18 seconds.

As an example, in the relaxation drive, in order to make air flow into the second pocket area 212 and the third pocket area 213 of the first air pocket unit 210 selected by the signal from the outside for the first opening time, the main injection valve 521 and some of the plurality of first auxiliary injection valves 522 may be opened and the plurality of pumps 400 may operate.

As another example, in the relaxation drive, in order to make air flow into the second pocket area 212, the third pocket area 213, the sixth pocket area 222, and the seventh air pocket 223 of the plurality of air pocket units 210 selected by the signal from the outside for the first opening time, the main injection valve 521, the second main injection valve 531, and some of the plurality of auxiliary injection valves 522 and some of the plurality of second auxiliary valve 532 may be opened and the plurality of pumps 400 may operate.

In addition, in the relaxation drive, after the first opening time, the plurality of valves 510, 520, 530, 540, and 550 and the plurality of pumps 400 may be controlled so that the hardness of other some of the plurality of pocket areas 211, 212, 213, 214, 221, 222, 223, and 224 of the air pocket unit 200 selected by the signal from the outside changes for a predetermined second opening time. Due to this relaxation drive, the air may flow into other some of the plurality of pocket areas 211, 212, 213, 214, 221, 222, 223, and 224 of the selected air pocket unit 200, so the hardness may increase. For example, the second opening time may be 12 to 18 seconds.

As an example, in the relaxation drive, in order to make air flow into the first pocket area 211 and the second pocket area 212 of the first air pocket unit 210 selected by the signal from the outside for second first opening time, the first main injection valve 521 and other some of the plurality of first auxiliary injection valves 522 may be opened and the plurality of pumps 400 may be driven.

As another example, in the relaxation drive, in order to make air flow into the first pocket area 211, the fourth pocket area 214, the fifth pocket area 221, and the eighth air pocket 224 of the plurality of air pocket units 200 selected by the signal from the outside for the first opening time, the main injection valve 521, the second main injection valve 531, and other some of the plurality of auxiliary injection valves 522 and some of the plurality of second auxiliary valve 532 may be opened and the plurality of pumps 400 may be controlled.

In addition, in this relaxation drive, at least some of the plurality of valves 510, 520, 530, 540, and 550 may be opened so that the plurality of pocket areas 211, 212, 213, 214, 221, 222, 223, and 224 of the air pocket unit 200 selected by the signal from the outside may communicate with each other for a predetermined relaxation waiting time. For example, the relaxation waiting time may be 1 to 2 seconds. Through the relaxation waiting time, the plurality of pocket areas 211, 212, 213, 214, 221, 222, 223, and 224 may form pressure balance.

For example, in the relaxation drive, the plurality of first injection valves 520 may be opened so that the first pocket area 211, the second pocket area 212, the third pocket area 213, and the fourth pocket area of the first air pocket unit 210 selected by the signal from the outside communicate with each other.

As another example, in the relaxation drive, the first injection valve 520 and the second injection valve 530 may be opened so that the plurality of pocket areas 211, 212, 213, 214, 221, 222, 223, and 224 of the plurality of air pocket units 200 selected by the signal from the outside communicate with each other for the relaxation waiting time.

In addition, in the relaxation drive, after the relaxation waiting time, at least some of the plurality of valves 510, 520, 530, 540, and 550 may be opened so that air is discharged from the air pocket unit 200 selected by an external signal for a predetermined relaxation discharge time. For example, the relaxation discharge time may be 20 to 30 seconds.

For example, in the relaxation drive, after the relaxation waiting time, the first injection valve 520 and the first exhaust valve 540 may be opened to discharge air from the first air pocket unit 210 selected by the signal from the outside for the relaxation discharge time.

As another example, in the relaxation drive, after the relaxation waiting time, the first injection valve 520, the second injection valve 530, the first exhaust valve 540, and the second exhaust valve 550 may be opened to discharge air from the first air pocket unit 210 selected by the signal from the outside for the relaxation discharge time.

In addition, in the relaxation drive, after the second opening time, when the pressure of the selected air pocket unit 200 measured through the sensor unit 600 is lower than the reference pressure preset in the controller 800, the plurality of pumps 400 may be re-driven to reach the reference pressure. After the second opening time, the relaxation drive may end without driving the pump 400 when the pressure of the air pocket unit 200 selected by the signal from the outside is greater than or equal to the reference pressure.

For example, in the relaxation drive, after the second opening time, when the pressure of the first air pocket unit 210 selected by the signal from the outside is lower than the reference pressure, the first pump 410 and the second pump 420 may be re-driven. In addition, the relaxation drive may end without driving the first pump 410 and the second pump 420 when the pressure of the selected first air pocket unit 210 is higher than the reference pressure.

As another example, in the relaxation drive, after the second opening time, when the pressure of the first air pocket unit 210 selected by the signal from the outside is lower than the reference pressure, the first pump 410 and the second pump 420 may be re-driven. In addition, the relaxation drive may end without driving the first pump 410 and the second pump 420 when the pressure of each of the plurality of selected air pocket units 200 is higher than the reference pressure.

In addition, when the relaxation drive ends, the controller 800 may open at least some of the plurality of valves 510, 520, 530, 540, and 550 so that the plurality of pocket areas 211, 212, 213, 214, 221, 222, 223, and 224 of the air pocket unit 200 selected by the signal from the outside communicate with each other for a predetermined delay time. For example, the delay time may be 1 to 3 seconds. Through the delay time, the plurality of pocket areas 211, 212, 213, 214, 221, 222, 223, and 224 may form pressure balance. In addition, after the delay time, the controller 800 may control the plurality of valves 510, 520, 530, 540, and 550 so that air is discharged from the selected air pocket unit 200 for a predetermined exhaust time. For example, the exhaust time may be 8 to 12 seconds.

For example, the controller 800 may open the plurality of first injection valves 520 for the delay time so that the first pocket area 211, the second pocket area 212, the third pocket area 213, and the fourth pocket area of the first air pocket unit 210 selected by the signal from the outside communicate with each other. After the delay time, the controller 800 may open the first injection valve 520 and the first exhaust valve 540 for the exhaust time so that air is discharged from the first air pocket unit 210 selected by the signal from the outside.

As another example, the controller 800 may open the first injection valve 520 and the second injection valve 530 for the delay time so that the plurality of pocket areas 211, 212, 213, 214, 221, 222, 223, and 224 of the plurality of air pocket units 200 selected by the signal from the outside communicate with each other to inject air. In addition, after the delay time, the controller 800 may open the first injection valve 520, the first injection valve 530, the first exhaust valve 540, and the second exhaust valve 550 for the exhaust time so that air is discharged from the plurality of air pocket units 210 selected by the signal from the outside.

After the exhaust time, when the pressure of the selected air pocket unit 200 measured through the sensor unit 600 is lower than the preset reference pressure, the controller 800 may re-drive the pump 400 to reach the reference pressure. For example, after the exhaust time, when the pressure of the selected first air pocket unit 210 is lower than the reference pressure, the controller 800 may re-drive the first pump 410 and the second pump 420.

In addition, after the exhaust time, when the pressure of the selected air pocket unit 200 measured through the sensor unit 600 is greater than or equal to the reference pressure, the controller 800 may control the plurality of pumps 400 and the plurality of valves 510, 520, 530, 540, and 550 to prevent air from flowing into the plurality of pocket areas 212, 213, 214, 221, 222, 223, and 224 of the selected air pocket unit 200. For example, after the exhaust time, when the pressure of the selected first air pocket unit 210 is greater than or equal to the reference pressure, the controller 800 may stop the first pump 410 and the second pump 420 and close the plurality of first injection valves 520.

The scan mode is a mode that increases or decreases the hardness level of one or more of the plurality of air pocket units 200 to 3 or more. The scan mode may be performed by a user lying on the mattress assembly 10 to explore the hardness suited to his or her body. For example, while the scan mode is performed, the hardness of the air pocket unit 200 may sequentially change from the lowest hardness level to the highest hardness level, and the user may select his/her desired hardness level by stopping the change in hardness level when his/her desired hardness level is reached. The hardness level may be set to one of the hardness levels pre-input through the scan mode, but may also be set to a hardness level that is a middle level between the pre-input hardness levels.

In the scan mode, the controller 800 may control the plurality of pumps 400 and the plurality of valves 510, 520, 530, 540, and 550 so that air is discharged from the air pocket unit 200 selected by the signal from the outside for the scan discharge time For example, the scan discharge time may be 18 to 22 seconds.

For example, in the scan mode, the controller 800 may stop the plurality of pumps 400 and open the first injection valve 520 and the first exhaust valve 540 so that air is discharged from the first air pocket unit 210 selected by the signal from the outside for the scan discharge time.

As another example, in the scan mode, the controller 800 may stop the plurality of pumps 400 and open the first injection valve 520, the second injection valve 530, the first exhaust valve 540, and the second exhaust valve 550 so that air is discharged from the plurality of air pocket units 210 selected by the signal from the outside for the scan discharge time.

In addition, in the scan mode, after the discharge time, the controller 800 may control the plurality of pumps 400 and the plurality of valves 510, 520, 530, 540, and 550 so that the scan mode is performed on the air pocket unit 200 selected by the signal from the outside.

For example, in the scan mode, the controller 800 may drive the first pump 410 and the second pump 420 to increase the current hardness level of the first air pocket unit 210 selected among the plurality of air pocket units 200 to 3 or more, and may open the first injection value 520. Prior to the injection of the air into the first air pocket unit 210, air may be discharged from the first air pocket unit 210 for the discharge time.

As another example, in the scan mode, the controller 800 may drive the first pump 410 and the second pump 420 to increase the current hardness level of the plurality of selected air pocket units 200 to 3 or more, and open the first injection valve 520 and the second injection valve 530. Prior to the injection of the air into the plurality of selected air pocket units 200, air may be discharged from the plurality of air pocket units 200 for the discharge time.

In addition, when the scan mode ends by the signal, the controller 800 may control the plurality of pumps 400 and the plurality of valves 510, 520, 530, 540, and 550 so that the hardness level of the selected air pocket unit 200 is maintained when the end signal is generated.

As an example, the controller 800 may stop the driving of the plurality of pumps 400 and close the first exhaust valve 540 and the first injection valve 520 so that the hardness of the first air pocket unit 210 selected by the end signal is maintained.

As another example, the controller 800 may stop the driving of the plurality of pumps 400 and close the first injection valve 520, the second injection valve 530, the first exhaust valve 540, and the second exhaust valve 550 so that the hardness of the plurality of air pocket unit 210 selected by the end signal is maintained.

Hereinafter, the operation and effect of the mattress assembly 10 and furniture 1 including the same according to an embodiment of the present disclosure will be described.

By the flow path valve 510 of the mattress assembly 10 according to an embodiment of the present disclosure, the air pressurized from the plurality of pumps 400 may flow into one of the first air pocket unit 210 and the second air pocket unit 220 quickly. In other words, the hardness of the first air pocket unit 210 or the second air pocket unit 220 may quickly increase by the air introduced by the plurality of pumps 400.

In addition, when one of the plurality of air pocket units 200 is selected by the operating unit 700 and the mode is selected, the controller 800 of the mattress assembly 10 according to an embodiment of the present disclosure may control the plurality of pumps 400 and the plurality of valves 510, 520, 530, 540, and 550 which will be described below.

In this relaxation drive of the relaxation mode, at least some of the plurality of valves 510, 520, 530, 540, and 550 may be opened so that the plurality of pocket areas 211, 212, 213, 214, 221, 222, 223, and 224 of the selected air pocket unit 200 may communicate with each other for the relaxation waiting time. After the relaxation waiting time, at least some of the plurality of valves 510, 520, 530, 540, and 550 may be opened so that air is discharged from the selected air pocket unit 200.

Thereafter, the plurality of valves 510, 520, 530, 540, and 550 and the plurality of pumps 400 may be controlled for the first opening time so that the hardness of some of the plurality of pocket areas 211, 212, 213, 214, 221, 222, 223, and 224 of the selected air pocket unit 200 increases. After the first opening time, the plurality of valves 510, 520, 530, 540, and 550 and the plurality of pumps 400 may be controlled for the second opening time so that the hardness of the other some of the plurality of pocket areas 211, 212, 213, 214, 221, 222, 223, and 224 of the selected air pocket unit 200 increases.

After the second opening time, when the pressure of the selected air pocket unit 200 is higher than the reference pressure, one relaxation drive may end without driving the plurality of pumps 400. In addition, after the second opening time, if the pressure of the selected air pocket unit 200 is lower than the reference pressure, the plurality of pumps 400 are re-driven so that the pressure is greater than or equal to the reference pressure, and when the pressure of the selected air pocket unit 200 is greater than or equal to the reference pressure, one relaxation drive may end.

When the relaxation mode ends, the plurality of valves 510, 520, 530, 540, and 550 may be controlled so that the plurality of pocket areas 211, 212, 213, 214, 221, 222, 223, and 224 communicate with each other for the delay time. After the delay time, the controller 800 may control the plurality of valves 510, 520, 530, 540, and 550 so that air is discharged from the selected air pocket unit 200 for a predetermined exhaust time.

After the exhaust time, when the pressure of the selected air pocket unit 200 is greater than or equal to the reference pressure, the plurality of pumps 400 and the plurality of valves 510, 520, 530, 540, and 550 may be controlled to prevent air from flowing into the plurality of pocket areas 212, 213, 214, 221, 222, 223, and 224 of the selected air pocket unit 200. In addition, after the exhaust time, when the pressure of the selected air pocket unit 200 is lower than the reference pressure, the pump 400 may be re-driven to be greater than or equal to the reference pressure.

Through this relaxation mode, since the hardness of some of each of the plurality of pocket areas 211, 212, 213, 214, 221, 222, 223, and 224 of the selected air pocket unit 200 may change to be different from the hardness of the other some of the plurality of pocket areas 211, 212, 213, 214, 221, 222, 223, and 224, different hardness may be provided for each part of the user's body. In other words, the mattress assembly 10 may provide massage to the user in the relaxation mode.

In addition, in the scan mode, the controller 800 may control the plurality of pumps 400 and the plurality of valves 510, 520, 530, 540, and 550 so that air is discharged from the selected air pocket unit 200 for the scan discharge time. After the scan discharge time, the plurality of pumps 400 and the plurality of valves 510, 520, 530, 540, and 550 may be controlled so that air flows into the selected air pocket unit 200 and the current hardness level of the selected air pocket unit 200 increases.

In addition, when the scan mode ends by the signal, the plurality of pumps 400 and the plurality of valves 510, 520, 530, 540, and 550 may be controlled so that the hardness level of the selected air pocket unit 200 is maintained when the signal is generated.

Through the scan mode, the user may select the hardness of the air pocket unit 200 that suits his or her body. In other words, the mattress assembly 10 may provide the hardness suited to the user's body.

Although embodiments of the present disclosure have been described above as specific embodiments, this is merely an example, and the present disclosure is not limited thereto, and should be construed as having the widest scope following the technical idea disclosed in this specification. A person skilled in the art may implement patterns of shapes not specified by combining/substituting the above-described embodiments, and therefore, this also does not depart from the scope of the present disclosure. In addition, since a person skilled in the art can easily change or modify the embodiments disclosed based on the present specification, it is clear that such changes or modifications also fall within the scope of the present disclosure.

What is claimed is:

1. A mattress assembly, comprising:

a plurality of air pocket units that include a first air pocket unit and a second air pocket unit for receiving air to support a user;

a flow channel that provides a flow path through which the air flows;

a plurality of pumps that include a first pump and a second pump for making the air flow into one or more of the plurality of air pocket units;

a valve unit that includes a plurality of valves selectively opened and closed to control the flow of air in the flow channel and the plurality of air pocket units; and a controller that controls the plurality of pumps and the valve unit to change hardness of one or more of the plurality of air pocket units, wherein the flow channel includes a first injection flow path member that provides a passage for the air to flow from the first pump to the first air pocket unit; a second injection flow path member providing a passage through which the air flows from the second pump to the second air pocket unit; and an air flow path through which the first injection flow path member communicates with the second injection flow path member, wherein the plurality of valves include a flow path valve provided between the first injection flow path and the second injection flow path that selectively opens or closes the air flow path, and the controller controls the plurality of pumps and the flow path valve so that the hardness of one or more of the first air pocket unit and the second air pocket unit changes by the air introduced by the plurality of pumps, and wherein, when the flow path valve is opened, the first injection flow path member communicates with the second injection flow path member through the air flow path, and when the flow path valve is closed, the first injection flow path member does not communicate with the second injection flow path member due to the flow path valve.

2. The mattress assembly of claim 1, wherein the one or more valves further include:

a first injection valve that opens and closes the first injection flow path member to make the air flow into the first air pocket unit; and a second injection valve that opens and closes the second injection flow path member to make the air flow into the second air pocket unit, and the controller closes either of the first injection valve or the second injection valve and opens the flow path valve so that the hardness of only one of the first air pocket unit and the second air pocket unit changes by the air introduced by the first pump and the second pump.

3. The mattress assembly of claim 1, wherein each of the plurality of air pocket units is divided into a plurality of pocket areas, the controller controls the plurality of pumps and the valve unit based on one or more control modes so that the hardness of one or more of the plurality of air pocket units changes, the one or more control modes include a relaxation mode in which a relaxation drive is performed one or more times to change the hardness of one or more of the plurality of air pocket units, and in the relaxation drive, one or more of the plurality of air pocket units is selected by a signal from an outside, and the valve unit and the pump are controlled so that, when the relaxation mode is selected, the hardness of some of the plurality of pocket areas of the selected air pocket unit changes for a predetermined first opening time, and the hardness of the other some of the plurality of pocket areas of the selected air pocket unit changes for a predetermined second opening time.

4. The mattress assembly of claim 3, wherein, in the relaxation drive, before the pump operates, at least some of the plurality of valves is opened so that the plurality of pocket areas of the selected air pocket unit communicate with each other for a predetermined relaxation waiting time, and after the relaxation waiting time, at least some of the plurality of valves is opened so that the air is discharged from the selected air pocket unit for a predetermined relaxation discharge time.

5. The mattress assembly of claim 3, further comprising:

a sensor unit that detects the pressure of the plurality of air pocket units, wherein, after the second opening time, when the pressure of the selected air pocket unit measured through the sensor unit is lower than a preset reference pressure, the pump is re-driven to reach the reference pressure, and if the pressure of the selected air pocket unit is higher than the preset reference pressure, the relaxation drive ends, when the pressure of the selected air pocket unit measured through the sensor unit is greater than or equal to the preset reference pressure, the pump ends without being driven, and the controller controls the valve unit and the pump so that the relaxation drive is repeatedly performed for multiple times.

6. A mattress assembly, comprising:

a plurality of air pocket units that include a first air pocket unit and a second air pocket unit for receiving air to support a user;

a flow channel that provides a flow path through which the air flows;

a plurality of pumps that include a first pump and a second pump for making the air flow into one or more of the plurality of air pocket units;

a valve unit that includes a plurality of valves selectively opened and closed to control the flow of air in the flow channel and the plurality of air pocket units;

a sensor unit that detects the pressure of the plurality of air pocket units; and a controller that controls the plurality of pumps and the valve unit to change hardness of one or more of the plurality of air pocket units, wherein each of the plurality of air pocket units is divided into a plurality of pocket areas, the controller controls the plurality of pumps and the valve unit based on one or more control modes so that the hardness of one or more of the plurality of air pocket units changes, the one or more control modes include a relaxation mode in which a relaxation drive is performed one or more times to change the hardness of one or more of the plurality of air pocket units, and in the relaxation drive, one or more of the plurality of air pocket units is selected by a signal from an outside, and the valve unit and the pump are controlled so that, when the relaxation mode is selected, the hardness of some of the plurality of pocket areas of the selected air pocket unit changes for a predetermined first opening time, and the hardness of the other some of the plurality of pocket areas of the selected air pocket unit changes for a predetermined second opening time, wherein the flow channel includes a first injection flow path member that provides a passage for the air to flow from the first pump to the first air pocket unit; a second injection flow path member providing a passage through which the air flows from the second pump to the second air pocket unit; and an air flow path communicating with the first injection flow path member and the second injection flow path member, wherein the plurality of valves include a flow path valve provided between the first injection flow path and the second injection flow path so that selectively opens or closes the air flow path, and the controller controls the plurality of pumps and the flow path valve so that the hardness of one or more of the first air pocket unit and the second air pocket unit changes by the air introduced by the plurality of pumps, when the relaxation mode ends, the controller controls to make a plurality of pocket areas of the selected air pocket unit communicate with each other for a predetermined delay time, and discharge the valve unit to discharge the air from the selected air pocket unit for a predetermined exhaust time after the delay time, and after the exhaust time, controls to re-drive the pump to reach the reference pressure when the pressure of the selected air pocket unit measured through the sensor unit is lower than the preset reference pressure, and controls the pump and the valve unit to prevent the air from flowing into the pocket area of the selected air pocket unit when pressure of the selected air pocket unit measured through the sensor unit is greater than or equal to the preset reference pressure.

7. The mattress assembly of claim 3, wherein the controller controls the air pocket unit to have a hardness level of 3 or more, the hardness level representing a preset relative value for the hardness of the air pocket unit, the one or more control modes further include a scan mode that increases or decreases the hardness level of one or more of the plurality of air pocket units to 3 or more, and the controller controls the pump and the valve unit so that the scan mode is performed for the selected air pocket unit when one or more of the plurality of air pocket units is selected by a signal from the outside.

8. The mattress assembly of claim 7, wherein the controller controls the pump and the valve unit to maintain the hardness level of the selected air pocket unit when the signal from the outside occurs if the scan mode ends by the signal from the outside.

9. A furniture, comprising:

the mattress assembly of claim 1; and a backrest disposed on one side of the mattress assembly.

* * * * *